United States Patent [19]

Fenoglio et al.

[11] Patent Number: 4,963,277

[45] Date of Patent: Oct. 16, 1990

[54] INCREASING VISCOSITY STORAGE STABIITY OF MANNICH BASE DISPERSANT/VI-IMPROVERS

[75] Inventors: David J. Fenoglio, Wheaton; Yoon S. Song; Robert J. Basalay, both of Naperville, all of Ill.

[73] Assignee: Amoco Corporation, Chicago, Ill.

[21] Appl. No.: 260,254

[22] Filed: Oct. 20, 1988

[51] Int. Cl.[5] ..... C10M 105/58

[52] U.S. Cl. ..... 252/51.5 A; 252/55; 252/51.5 R

[58] Field of Search ..... 252/51.5 A, 55, 50, 252/51, 51.5 R

[56] References Cited

U.S. PATENT DOCUMENTS

| | | | |
|---|---|---|---|
| 3,872,019 | 3/1975 | Culbertson | 252/51.5 A |
| 4,379,064 | 4/1975 | Cengal | 252/51.5 A |
| 4,455,244 | 6/1984 | Smyser | 252/51.5 AX |

*Primary Examiner*—Olik Chaudhuri
*Assistant Examiner*—James M. Hunter, Jr.
*Attorney, Agent, or Firm*—Matthew R. Hooper; William H. Magidson; Ralph C. Medhurst

[57] ABSTRACT

A method is described for improving the viscosity storage stability of a Mannich base condensation product of an oxidized polyolefin, formaldehyde, and an amine. This method involves contacting such Mannich base condensation product with a lower alkyl peroxide, a lower alkyl hydroperoxide or an aryl(lower)alkyl hydroperoxide at a temperature of about 250° F. to about 400° F. for a time period sufficient to provide an oxidized product.

11 Claims, No Drawings

INCREASING VISCOSITY STORAGE STABIITY OF MANNICH BASE DISPERSANT/VI-IMPROVERS

FIELD OF INVENTION

The present invention relates to certain Mannich bases suitable as dispersants and viscosity index improvers in crankcase lubricants, such Mannich bases being modified to enhance storage stability, and to processes for achieving such modification.

BACKGROUND OF INVENTION

Mannich base condensation products which impart both viscosity index improving properties and dispersant properties to multigrade crankcase lubricants can be made by the condensation of oxidized olefinic polymer, formaldehyde (or formaldehyde precursor), and an amine. Processes for their preparation are taught in various patents (see, for example, U.S. Pat. No. 3,872,019 to Culbertson et al.).

The treatment of such Mannich base condensation products with oxygen (in air) to reduce their reactivity towards fluorocarbon elastomers used in engine seals is described in U.S. Pat. No. 4,455,244 to Smyser et al.

The treatment of such Mannich base condensation products with oxygen, inorganic peroxides, or percarboxylic acids to improve the fluorocarbon elastomer compatibility of a Mannich base dispersant is described in U.S. Pat. No. 4,379,064 to Cengel et al.

To the best of our knowledge however, nothing in the prior art has taught or suggested that the viscosity stability during storage of a Mannich base condensation product made with formaldehyde, a polyamine and an oxidized polyolefin could be improved by an oxidizing treatment with lower alkyl peroxides, lower alkyl hydroperoxides, or aryl(lower)alkyl hydroperoxides.

SUMMARY OF THE INVENTION

Mannich bases derived from oxidized olefin polymers, when treated as taught herein, exhibit reduced viscosity change during storage.

More particularly, Mannich bases, which are condensation products of an oxidized olefin polymer, an aliphatic amine, and an aliphatic aldehyde, are contacted with at least one member selected from the group consisting of a lower alkyl peroxide, a lower alkyl hydroperoxide, and an aryl(lower)alkyl hydroperoxide, at a temperature of about 250° to 400° F.) for a time period of preferably about 1 to about 5 hours.

The resulting Mannich base product has superior storage viscosity stability compared to the starting Mannich base. Most, if not all of the viscosity index improving properties of the starting Mannich base are retained in such products with little if any loss in the dispersant properties thereof.

The resulting Mannich base product also has superior color characteristics compared to the starting Mannich base.

The resulting Mannich base product further has superior fluorocarbon elastomer compatibility characteristics compared to the starting Mannich base.

Other and further aspects, applications, advantages, and the like of the present invention will be hereinafter apparent to those skilled in the art.

DETAILED DESCRIPTION

I

The Starting Mannich Base

A starting Mannich base suitable for the practice of the present invention is generally described in U.S. Pat. No. 3,872,019 to Culbertson et al. Such a Mannich base is obtainable as follows.

First, an ethylene-propylene copolymer dissolved in an oil substantially inert towards the starting materials and the reaction products is subjected to oxidative degradation with oxygen (conveniently obtained from air) to give a starting polymer which contains reactive sites suitable for Mannich condensation with amines and formaldehyde. The reactive sites are believed to be ketone groups. A present preference is to use an oxidized long-chain amorphous copolymer comprised of ethylene and propylene having a number average molecular weight of at least about 10,000 and containing at least about 140 pendant methyl groups per 1000 chain carbon atoms.

For the intended Mannich condensation, a formaldehyde-yielding aliphatic aldehyde reactant containing less than 7 carbon atoms per molecule, and preferably less than 5 carbon atoms per molecule, such as, for example, formaldehyde, formalin, paraformaldehyde, acetaldehyde, betahydroxybutyraldehyde, or the like, is used, together with an amine, such as an aliphatic amine containing per molecule 1 to about 30 carbon atoms, 1 to about 8 amino groups, at least one of which is a primary amino group, and up to about 3 hydroxyl groups.

A presently preferred class of starting aliphatic amines contains 2 to 8 carbon atoms per molecule, and optionally 1 or 2 hydroxyl groups per molecule.

Examples of suitable amines and polyamines include methylamine, dibutylamine, cyclohexylamine, propylamine, decylamine, ethylenediamine, trimethylene diamine, tetramethylene diamine, hexamethylene diamine, dodecylmethylene diamine, diethylene triamine, triethylene tetramine, tetraethylene pentamine, tripropylene tetramine, tetrapropylene pentamine, other polyalkylene polyamines in which the alkylene groups contain suitably up to about 10 carbon atoms each, triethanolamine, and tris(hydroxymethyl)methylamine.

Preferred amines are alkylene diamines having the general formula $NH_2—(CH_2)_n—NH_2$ where n is 2 to 12.

Suitable Mannich base condensation conditions for reacting a mixture of (a) formaldehyde yielding reactant, (b) the aliphatic amine, and (c) the oxidized ethylene/propylene copolymer involve heating a mixture of such reactants at about 250° F. to about 400° F. Reaction times are not critical, and are in the range of about 1 to about 8 hours. Shorter and longer times may be used as well. One-step reactions are preferred, but are not necessary.

The molar ratios of the reactants are conventional in the art. Condensation is preferably carried out in a non-reactive organic diluent (the term diluent also including the term solvent), such as, for example, in an aromatic hydrocarbon solvent, e.g., benzene, xylene, toluene, etc., or in an aliphatic hydrocarbon solvent, such as hexane, for example. Particularly suitable as a solvent or diluent is a low viscosity hydrocarbon oil, such as a solvent-extracted SAE 5W mineral oil. The use of a solvent or diluent is particularly advantageous to facilitate the mixing of the reactants, and the control of the reaction temperatures. The solvent or diluent can be introduced into the reaction by initially dissolving the ethylene propylene copolymer in neutral process oil prior to oxidation of the copolymer. The polymer in oil solution preferably contains about 5 to 15 wt. % dissolved polymer and about 85 to 95 percent neutral oil.

II

The Starting Peroxides and Hydroperoxides

Oxidation of the above-described Mannich base in accord with the present invention is carried out with at least one material selected from the group consisting of:

(a) a di(lower alkyl) peroxide, (b) a lower alkyl hydroperoxide, and (c) an aryl(lower)alkyl hydroperoxide.

Lower alkyl hydroperoxides, lower alkyl peroxides, and aralkyl hydroperoxides wherein the alkyl group is a lower alkyl moiety are contemplated because the residues remaining therefrom after oxidation of the Mannich base do not need to be separated from the ultimate product. Such residues appear to have a minimal effect upon a crankcase lubricant composition containing oxidized Mannich base products in accordance with this invention. The term "lower" as used herein means a radical containing less than 7 carbon atoms in the alkyl portion of the molecule. Presently particularly preferred are di(t-butyl) peroxide or t-butyl hydroperoxide.

Examples of suitable lower alkyl hydroperoxide compounds include methyl hydroperoxide, ethyl hydroperoxide, propyl hydroperoxide, butyl hydroperoxide, sec-butyl hydroperoxide, iso-butyl hydroperoxide, tert-butyl hydroperoxide, n-amyl hydroperoxide, n-hexyl hydroperoxide, and the like.

Examples of suitable aryl(lower)alkyl hydroperoxides include tolyl hydroperoxide, o-, p-, and m-xylene hydroperoxide, alpha-phenylethyl hydroperoxide, diphenylmethyl hydroperoxide, alpha-cumyl hydroperoxide, lower alkyl substituted alpha-cumyl hydroperoxide, and the like.

Examples of suitable di(lower)alkyl peroxides include dimethyl peroxide, diethyl peroxide, ethyl methyl peroxide, n-butyl t-butyl peroxide, di(n-butyl)peroxide, di(t-butyl)peroxide, di(n-hexyl)peroxide, and the like.

Mixtures of the foregoing hydroperoxides and peroxides can also be used, if desired.

The Oxidation Process

In the practice of this invention, the Mannich base and an alkyl peroxide compound [that is, a lower alkyl peroxide, a lower alkyl hydroperoxide or an aryl(lower-)alkyl hydroperoxide]are combined, and the resulting mixture is heated. The amount of peroxide compound used is in the range of about 0.1 to about 5 wt. % of the Mannich compound.

Typical oxidation temperatures are in the range of about 250° to about 450° F., and preferably about 300 to about 400° F. Oxidation is carried out for a time period which is preferably in the range of about 1 to about 5 hours. In general, the amount of time can be regarded as being inversely related to the oxidizing temperature, that is, the relatively higher temperatures require relatively shorter treating times, and vice versa.

Treatment of the starting Mannich base with such an alkyl peroxide compound generally yields products which are at least equal to, but usually lighter in color than, the corresponding starting Mannich base.

Such post oxidizing treatment of the Mannich base, for example, at both about 300° F. and also at about 370° F. produces products with similar respective properties relative to one another. This result indicates that the process of this invention provides a desirable, relatively wide choice of process options for commercial scale operating purposes. Also, the respective products made at about 300° F. and at about 370° F. display similar improved viscosity stability compared to the corresponding starting Mannich base.

In contrast, when the starting Mannich bases are oxidized with, for example, air, the products are darker in color than the starting Mannich base. Also, air treatment at about 300° F. and at about 370° F. produces products with different respective properties.

Also, and in further contrast, oxidation of the starting Mannich bases with hydrogen peroxide yields products which are darker in color than the color of the products produced with alkyl peroxides or alkyl hydroperoxides.

III

The Oxidized Mannich Base

As indicated above, the product of the process of this invention is an oxidized Mannich base. Such products display improved storage viscosity stability compared to the corresponding starting Mannich bases. Also, such products display lighter colors than the corresponding starting Mannich bases. The oxidized Mannich base products having a light color, such as results from the practice of this invention, have better commercial and aesthetic value than do corresponding products having a darker color.

Further, such products display reduced reactivity towards fluorocarbon elastomers (of the type commonly employed for engine seals), as compared to the corresponding starting Mannich bases.

Still further, such products display better dispersant properties compared both to the corresponding starting Mannich bases, and also to the corresponding prior art oxidized Mannich bases produced by air treatment or hydrogen peroxide treatment.

Both the starting Mannich base condensates as well as the oxidized Mannich base products of this invention display viscosity index improving capacity.

Multigrade crankcase lubricants commonly contain a plurality of additives, which serve various functions, such as detergents, dispersants, oxidation inhibitors, wear inhibitors, rust inhibitors, and the like, as those skilled in the art appreciate. The oxidized Mannich base products of this invention are fully compatible with such conventional additives in crankcase lubricant formulations.

IV

Crankcase Lubricant Compositions

In use, the oxidized Mannich base condensation products of the present invention are combined with base oil in an amount of about 0.1 to 10 percent by weight based on total resulting lubricant composition. Larger and smaller amounts can be employed if desired without departing from spirit and scope of the invention.

For example, such an oxidized Mannich base product can be admixed with, and dissolved in, a base oil usually with the aid of heat. As those skilled in the art appreciate, crankcase lubricants ordinarily have a viscosity ranging about 1300 cSt at 0° F. to 22.7 cSt at 210° F. The total amount of such additive that is incorporated into a given crankcase lubricant preferably is about 0.5 to about 8.0 weight percent (and more preferably about 1 to about 5 weight percent) based upon the total weight of crankcase lubricant formulation.

The base oil used in formulating a crankcase lubricant can be a synthetic oil or a mineral oil. Examples of suitable mineral oils include paraffinic, naphthenic, and other mineral oils that are ordinarily used in lubricating oil compositions. Suitable synthetic oils include both hydrocarbon synthetic oils and synthetic esters. Examples of synthetic hydrocarbon oils include liquid polymers of alpha olefins, such as hydrogenated liquid oligomers of $C_{6-12}$ alpha olefins, such as 1-decene trimer, as well as alkylbenzenes, such as didodecyl benzene. Examples of synthetic esters include esters of both monocarboxylic acid and polycarboxylic acids as well as monohydroxy alkanols and polyols. Particular examples include didodecyl adipate, pentaerythritol, tetracaproate, di-2-ethylhexyl adipate, dilaurylsebacate, and the like. Also suitable are complex esters prepared from mixtures of mono and dicarboxylic acid and mono and dihydroxy alkanols. Blends of hydrocarbon oils with synthetic oils are also useful. For example, blends of about a 20 to 25 weight percent hydrogenated 1-decene trimer with 75 to 90 weight percent 150 SUS (100° F.) mineral oil and the like can be used as lubricating oil bases.

The oxidized Mannich base condensates of this invention are particularly well-suited for use in a crankcase lubricant composition which comprises a base oil that contains, as additives, not only the oxidized Mannich base condensate of this invention, but also known dispersants, detergents, oxidation inhibitors, wear inhibitors, rust inhibitors, and, when a multigrade oil is contemplated, known viscosity index improvers.

Known members of such respective additive types can be selected for use with the products of this invention. For example:

Ashless dispersants are preferably used. Examples of such dispersants include alkyl polyamides, nitrogen-containing methacrylate polymers and the like.

Suitable detergents include neutral or overbased alkyl or alkylene earth metal phenates, sulfonates or salicylates.

Suitable oxidation inhibitors include hindered phenols, aromatic amines, oil soluble copper compounds, and the like.

Suitable wear inhibitors include organic phosphates, organic sulfur and chlorine compounds, and the like.

Suitable rust inhibitors include metal sulfonates, fatty acids and amines, and the like.

Suitable viscosity index improvers, which can optionally be used in combination with the oxidized Mannich base condensate of this invention, include methacrylate polymers, butylene polymers, polymerized olefins or isoolefins, alkylated styrene polymers, and the like.

A crankcase lubricant composition of the present invention is used by charging the crankcase of an internal combustion engine with such a lubricant composition and operating the engine in a normal manner. The engine can be of the compression-ignition (diesel) type or the spark-ignition (gasoline) type.

Various other types of compatible additives known to those skilled in the art may additionally be present in a crankcase lubricant composition of the present invention, including, for example, friction modifiers, foam inhibitors, corrosion inhibitors, metal deactivators, pour point depressants, and the like.

The following examples are offered to specifically illustrate this invention. These examples are not to be construed as limiting the scope thereof, however.

Starting Materials

Preparation of Mannich Base

The starting Mannich base is a dispersant and viscosity index-improving additive prepared in the following manner.

EXAMPLE I

Oxidation of the Copolymer

An oxidized copolymer ("Sample I") was obtained as follows: 500 grams of an ethylene propylene copolymer containing about 40 mole% propylene having an average molecular weight of about 150,000 g/mole was dissolved in 4,500 grams of 100N process oil at 250° to 320° F. with stirring under nitrogen in a flask fitted with a stirrer and means to sparge a 50/50 mixture of air and nitrogen through the contents. The copolymer was added to the oil after adding 10 grams of overbased magnesium polypropylbenzene sulfonate color inhibitor, having an equivalent weight of about 600 grams, containing about 9.4 percent magnesium, and having a 400 mg of KOH/g TBN. After the copolymer-oil mixture was stirred overnite to insure complete solution of copolymer in oil, the solution was heated to 350°–400° F. and 10 grams of polypropylbenzene sulfonic acid, having an equivalent weight of about 600 grams, was added as an oxidation catalyst. The oxidative degradation was then begun by blowing nitrogen and air through the reaction media, each at 1,600 cc/min, while stirring at 325 rpm. After approximately 3 to 5 hours, the viscosity was reduced from approximately 16,000 cSt, both measured at 100° C.

EXAMPLE II

Oxidation of the Copolymer

An oxidized copolymer (Sample II) was obtained in accordance with the procedures described in Example I above except the copolymer was oxidized to a final viscosity of 270 cSt.

EXAMPLE III

Mannich Reaction

Mannich condensation products from the oxidized polymers (Samples I and II) were prepared by adding slowly to the copolymer with stirring at 360° F., 19 grams of propylbenzene sulfonic acid catalyst, 15 grams of hexamethylene diamine, and 25 grams of 37% aqueous solution of formaldehyde. After the addition of the reagents, the reaction was stirred one hour at 360° F. and then stripped with nitrogen for one hour. Mannich product from Sample I had a final viscosity of 450 centistokes and the product from Sample II had a final viscosity of 376 centistokes.

EXAMPLE IV

A Mannich base of Example I–III was treated with each of (a) di(t-butyl) peroxide, and (b) t-butyl hydroperoxide using the following procedure for each treatment:

(a) di(t-butyl)peroxide (a)(i) After copolymer was oxidized in oil as in Example II, and aminated to a Mannich base as in Example III except at 300° F., 750 g of the resulting Mannich base was held at 300° F. under nitrogen sparge with stirring, and was post oxidized by adding 3.75 grams of di(t-butyl) peroxide, 0.5 wt. %, dropwise. The mixture was held at temperature for one hour before cooling-/quenching reaction mixture.

(a)(ii) After copolymer was oxidized in oil as in Example II, and aminated to a Mannich base as in Example III except at 300° F., 750 g of the resulting Mannich base was held at 300° F. under nitrogen sparge with stirring, and was post oxidized by adding 7.5 grams of di(t-butyl) peroxide, 1.0 wt. %, dropwise. The mixture was held at temperature for one hour before cooling-/quenching reaction mixture.

(a)(iii) After copolymer was oxidized in oil as in Example II, and aminated to a Mannich base as in Example III except at 370° F., 750 g of the resulting Mannich base was held at 370° F. under nitrogen sparge with stirring, and was post oxidized by adding 7.5 grams of di(t-butyl) peroxide, 1.0 wt. %, dropwise. The mixture was held at temperature for one hour before cooling-/quenching reaction mixture.

(a)(iv) After copolymer was oxidized in oil as in Example II, and aminated to a Mannich base as in Example III except at 370° F., 750 g of the resulting Mannich base was held at 370° F. under nitrogen sparge with stirring, and was post oxidized by adding 15 grams of di(t-butyl) peroxide, 2.0 wt. %, dropwise. The mixture was held at temperature for one hour before cooling-/quenching reaction mixture.

(b) t-butylhydroperoxide (b)(i) After copolymer was oxidized in oil as in Example II, and aminated to a Mannich base as in Example III except at 300° F., 750 g of the resulting Mannich base was held at 300° F. under nitrogen sparge with stirring, and was post oxidized by adding 3.75 grams of t-butylhydroperoxide, 0.5 wt. %, dropwise. The mixture was held at temperature for one hour before cooling/quenching reaction mixture.

(b)(ii) After copolymer was oxidized in oil as in Example II, and aminated to a Mannich base as in Example III except at 300° F., 750 g of the resulting Mannich base was held at 300° F., under nitrogen sparge with stirring, and was post oxidized by adding 7.5 grams of t-butylhydroperoxide, 1.0 wt. %, dropwise. The mixture was held at temperature for one hour before cooling/quenching reaction mixture.

Each of the products thus produced was an oil soluble oxidized Mannich base having dispersant capabilities and enhanced viscosity stability upon storage.

EXAMPLE V

A Mannich base of each of Example I–III is treated with cumyl hydroperoxide using the procedure described above.

EXAMPLE VI

Comparison of Viscosity and Color

The viscosity characteristics and color for the di(t-butyl) peroxide and t-butyl hydroperoxide products of Example IV were evaluated and compared to the starting Mannich base untreated with peroxide as prepared in Examples I–III. The results are shown in Table I below:

TABLE I

Oxidation of Mannich Base with Di(t-butyl) Peroxide and T-butyl Hydroperoxide

| | Ex IV (a) (i) | Ex IV (a) (ii) | Ex IV (a) (iii) | Ex IV (a) (iv) | Ex IV (b) (i) | Ex IV (b) (ii) |
|---|---|---|---|---|---|---|
| Reaction Temp. °F. | 300 | 300 | 370 | 370 | 300 | 300 |
| Peroxide[1] | $+O_2$ | $+O_2$ | $+O_2$ | $+O_2$ | +OOH | +OOH |
| Wt. % Used | 0.5 | 1.0 | 1.0 | 2.0 | 0.5 | 1.0 |
| Mannich Base | | | | | | |
| Vis (100° C.), cSt | 461 | 449 | 447 | 454 | 406 | 395 |
| N, ppm | 749 | 834 | 692 | 670 | 891 | 889 |
| Oxidized Mannich Base | | | | | | |
| Vis (100° C.), cSt | 520 | 514 | 525 | 492 | 470 | 471 |
| N, ppm | 759 | 861 | 642 | 675 | 682 | 863 |
| ASTM Color (dil.) | 3.0– | 3.0– | 3.5 | 3.5– | 3.0– | 2.5 |
| ASTM Color (neat) | 7.5 | 7.0 | 7.5 | 7.5 | 6.5– | 6.0 |
| SDT at 3%[2] | | | | | | |
| Mannich Base | 87.6 | 92.0 | 91.3 | — | 89.0 | 84.9 |
| Oxidized Mannich Base | 91.3 | 93.4 | 82.6 | 93.4 | 88.6 | 88.5 |

Table I Footnotes:
[1]Abbreviations: $+O_2$ = di(t-butyl)peroxide +OOH = t-butyl hydroperoxide
[2]"SDT" connotes a conventional Spot Dispersancy Test As can be seen from the data in Table I, the oxidized Mannich bases produced in accord with the teachings of this invention by treatment with alkyl peroxide or alkyl hydroperoxide:

(1) display excellent dispersant capability, and
(2) display a superior light color character.

EXAMPLE VII

Evaluation of Compatibility with Fluorocarbon Engine Seal Elastomers of Oxidized and Non-Oxidized Mannich Bases The products of Example IV above, were evaluated for fluorocarbon elastomer compatibility by the following procedure and using a "Viton" elastomer. "Viton" is the trademark of E.I. du Pont de Nemours & Co. for a brand of fluorocarbon elastomer.

A suitable blending vessel equipped with means for heating and stirring was charged with 93.6 grams of a product to be evaluated and 1506.4 grams of a fully formulated crankcase lubricant containing various additives except for the ashless dispersant. The mixture was heated to about 71° C. with stirring, and maintained at that temperature for about one hour. About 500 ml of the mixture was placed in each of four 600 ml double-lipped beakers. Four specimens of Viton elastomer, supported on a wire hanger suspended from a glass rod, were placed in each of the beakers. The beakers were then covered with a petri dish, placed in an oven at 150° C., and kept for four days at that temperature. After four days, the beakers were removed from the oven, cooled, and the elastomer specimens were wiped with a paper towel to remove the excess oil. The modulus of the specimens at 33.3% elongation was measured, and averaged over the four specimens. The result was compared to the value for untested (control) Viton elastomer specimens. An average percent change was determined. An oil passes this test if the percent change is no larger than 25% and the specimens are free of cracks (crazing) as determined by a visual inspection. All of the test samples passed on percent change in elongation. The designation "VLT" means that very light crazing was noted, and the designation "LT" means that light crazing was noted. The results are shown in Table II, below.

TABLE II

| Evaluation of Fluorocarbon Elastomer Elasticity | | |
|---|---|---|
| Mannich Base Oxidized With: | Compatibility of Oxidized Mann. Base | |
| | Δ Elong. | Crazing |
| (0.5 wt. % $+O_2$)(1) | Pass | No-2VLT |
| (1.0 wt. % $+O_2$)(2) | Pass | 3No-VLT |
| (2.0 wt. % $+O_2$)(3) | Pass | 4No |
| (0.5 wt. % +OOH)(3) | Pass | 3No-VLT |
| $H_2O_2$ | Pass | 2No-2VLT |

Table II Footnotes:
(1)Oxidized product produced by oxidizing the Mannich base of Ex. I–III at 300° F. with di(t-butylperoxide ($+O_2$)
(2)Oxidized product produced by oxidizing the Mannich base of Ex. I–III at 370° F. with di(t-butyl)peroxide ($+O_2$)
(3)Oxidized product produced by oxidizing the Mannich base of Ex. I–III at 300° F. with t-butyl hydroperoxide (+OOH)

As can be seen from the data in Table II, the oxidized Mannich bases produced in accord with the teachings of this invention by treatment with alkyl peroxide and alkyl hydroperoxide are compatible with fluorocarbon elastomers.

EXAMPLE VIII

Comparison of Storage Stabilities of Mannich Bases Oxidized with Di(t-butyl) Peroxide and Hydrogen Peroxide To compare the storage stability of an oxidized Mannich base as produced by the teachings of this invention with the storage stability of an oxidized Mannich base of the type produced by following the teachings of U.S. Pat. No. 4,455,244 to Smyser et al., the following tests were carried out.

Samples of the oxidized Mannich base produced by oxidizing at 300° F. the Mannich base of Examples I–III with di(t-butyl) peroxide following the procedure described in Example IV above, were compared with samples of the same Mannich base oxidized by $H_2O_2$.

Thereafter, each sample was subjected to the following storage stability testing procedure:

30 grams of sample were added to 25 mm diameter by 95 mm vials and the vials were capped under nitrogen. The vials containing sample were placed in a heated block drilled with suitable holes to hold the vials. The heating block was held at 240° F. for the duration of the testing. Vials were added to the block capped, storage under nitrogen, or uncapped, storage under air, and the samples in the vials were then examined for viscosity at 100° F. after storage for the desired time.

The results are shown in Table III below:

TABLE III

| Comparative Storage Stabilities of Oxidized Mannich Bases | | |
|---|---|---|
| Holding period at 240° F. | % Change in Viscosity of Product of Mannich Base Treated with: | |
| | 0.5 wt. % $H_2O_2$ | 0.5 wt. % $+O_2$ |
| 2 days (under nitrogen) | +5.9 | +2.4 |
| 5 days | 10.0 | 3.1 |
| 7 days | 11.9 | 3.3 |
| 2 days (under air) | 13.8 | 7.2 |
| 4 days | 21.6 | 15.5 |
| 7 days | 30.2 | 30.9 |

As can be seen from the data in Table III, the oxidized Mannich base produced by treating with di(t-butyl) peroxide was substantially more stable during storage than the same oxidized Mannich base produced by treating with hydrogen peroxide.

We claim:

1. A method for improving the viscosity stability upon storage of a Mannich base viscosity index improving composition, said composition comprising about 85 to 95 wt. % of low viscosity hydrocarbon oil and about 5 to 15 wt. % of a Mannich base condensation product of an oxidized polyolefin, an aliphatic aldehyde, and an aliphatic amine, said method comprising the steps of:

(a) combining said Mannich base viscosity index improving composition with an oxidizing material selected from the group consisting of a dialkyl peroxide, an alkyl hydroperoxide, an arylalkyl hydroperoxide, and a mixture thereof, wherein the alkyl moieties of said hydroperoxides contain seven carbons or less, and (b) maintaining the resulting combination at a temperature of about 250° F. to about 400° F. for a time period of about 1 to about 5 hours.

2. The process of claim 1 wherein said oxidizing material is t-butyl hydroperoxide.

3. The process of claim 1 wherein said oxidizing material is di(t-butyl)peroxide.

4. The process of claim 1 wherein said mixture is maintained at a temperature of about 300° to about 370° F. for a time period of about 1 to about 3 hours.

5. An oxidized Mannich base viscosity index improving composition produced by the process of claim 1.

6. An oxidized Mannich base viscosity index improving composition produced by the process of claim 2.

7. An oxidized Mannich base viscosity index improving composition produced by the process of claim 3.

8. A lubricating oil composition comprising:

(a) an oil of lubricating viscosity, and (b) an oxidized Mannich base viscosity index improving composition produced by a process comprising the steps of:

(i) combining said Mannich base viscosity index improving composition with an oxidizing material selected from the group consisting of a dialkyl peroxide, an alkyl hydroperoxide, an arylalkyl hydroperoxide, and a mixture thereof, wherein the alkyl moieties of said hydroperoxides contain seven carbons or less, and (ii) maintaining the resulting combination at a temperature of about 250° F. to about 400° F. for a time period of about 1 to about 5 hours.

9. The method of claim 1 wherein said Mannich base is a condensation product of:

(a) an aliphatic aldehyde containing less than 7 carbon atoms per molecule, (b) an aliphatic amine containing per molecule 1 to about 20 carbon atoms, from 1 to about 8 amino groups, at least one of which is a primary amino group, and (c) an oxidized long-chain amorphous copolymer comprised of ethylene and propylene having an umber average molecular weight of at least about 10,000, containing at least about 140 pendant methyl groups per 1000 chain carbon atoms.

10. An oxidized Mannich base vicosity index improving composition produced by the process of claim 9.

11. A method for operating an internal combustion engine comprising the steps of:

(a) charging the crankcase of said engine with a lubricating oil composition containing a major amount of oil of lubricating viscosity and a minor viscosity-index improving amount of a Mannich base viscosity index improving composition, said viscosity index improving composition comprising about 85 to 95 wt. % of low viscosity hydrocarbon oil and about 5–15 wt. % of a Mannich base condensation product of an oxidized polyolefin, an aliphatic aldehyde, and an aliphatic amine, wherein said Mannich base viscosity index improving composition is obtained by the process comprising the steps of:

(i) combining said Mannich base viscosity index improving composition with an oxidizing material selected from the group consisting of a dialkyl peroxide, an alkyl hydroperoxide, an arylalkyl hydroperoxide, and a mixture thereof, wherein the alkyl moieties of said hydroperoxides contain seven carbons or less, and (ii) maintaining the resulting combination at a temperature of about 250° F. to about 400° F. for a time period of about 1 to about 5 hours; and (b) operating said engine with said crankcase so charged.

* * * * *